US006506067B2

(12) United States Patent
Piemontesi et al.

(10) Patent No.: US 6,506,067 B2
(45) Date of Patent: Jan. 14, 2003

(54) DISCONNECTOR

(75) Inventors: Marco Piemontesi, Biasca (CH); Gerhard Salge, Stein (CH); Christoph Heitz, Elgg/ZH (CH); Herbert Meinecke, Winterthur (CH); Diego Sologuren-Sanchez, Wettingen (CH)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/942,916

(22) Filed: Aug. 31, 2001

(65) Prior Publication Data

US 2002/0028594 A1 Mar. 7, 2002

(30) Foreign Application Priority Data

Sep. 4, 2000 (EP) ..... 00810793

(51) Int. Cl.[7] ..... H01R 13/53
(52) U.S. Cl. ..... 439/184; 439/186; 218/136
(58) Field of Search ..... 439/184, 181, 439/186; 218/18, 117, 99, 80, 138

(56) References Cited

U.S. PATENT DOCUMENTS 3,812,314 A * 5/1974 Nonken ..... 218/138
4,256,938 A 3/1981 Efinger et al.
4,413,166 A * 11/1983 Meyer ..... 218/80

FOREIGN PATENT DOCUMENTS

| | | |
|---|---|---|
| DE | 1131771 | 6/1962 |
| DE | 1247505 | 8/1967 |

* cited by examiner

*Primary Examiner*—Gary Paumen
*Assistant Examiner*—Felix O Figueroa
(74) *Attorney, Agent, or Firm*—Burns, Doane, Swecker & Mathis, L.L.P.

(57) ABSTRACT

The disconnector essentially comprises two isolating contacts (2), which are arranged in electrically conductive encapsulation (1) filled with insulating gas, and an isolating contact finger (3) arranged such that it can be moved between them. An insulation coating (7) is applied to the inside of the encapsulation (1) and has projections (8) pointing inward.

The insulation coating prevents a disconnector spark (5), whose production cannot be avoided when the disconnector is opened, from flashing over onto the encapsulation (1). Furthermore, additional projections (9) prevent the spark from propagating in the direction of the isolating contacts (2).

5 Claims, 1 Drawing Sheet

DISCONNECTOR

FIELD OF THE INVENTION

The invention is based on a disconnector according to the preamble of patent claim 1.

Such a disconnector is used within gas-insulated switchgear assemblies.

BACKGROUND OF THE INVENTION

Disconnectors within gas-insulated switchgear assemblies (GIS) are dielectrically critical components since they have small radii and therefore cause inhomogeneities in the shape of the electric field.

A disconnector essentially comprises grounded encapsulation, two isolating contacts which are held, generally centrally, in the encapsulation by supporting insulators, and a moveable isolating contact finger. The isolating contact finger is arranged such that it can be moved between the isolating contacts. When the disconnector is open, the isolating contact finger is essentially located within one of the isolating contacts, so that the distance between the two isolating contacts forms the isolation gap. When the disconnector is closed, the isolating contact finger bridges the isolation gap between the two isolating contacts, and thus forms a conductive connection. During opening and closing of the disconnector, the isolating contact finger is moved in the direction of one isolating contact or the other, forming disconnector sparks, until the isolation gap is completely open or closed.

The encapsulation of conventional disconnectors is designed to be enlarged in particular in the region of the isolation gap in order to prevent a disconnector spark from flashing over to the encapsulation during the switching process. The encapsulation is generally in the form of a casting, which is complex and expensive to produce.

DE 1,131,771 discloses a disconnector in which a solid insulation coating is applied to the inside of the encapsulation. In order to prevent creepage currents from bridging the open disconnector along the solid insulation coating on the encapsulation, the solid insulation coating is interrupted in the region of the center of the isolation gap by a convex, grounded bead. In order to prevent any flashovers from the isolating contact finger to the grounded bead while the disconnector is being opened, an additional tubular insulation shield is provided, covering the bead.

SUMMARY OF THE INVENTION

The invention is based on the object of providing a disconnector of the type mentioned initially, which has high dielectric strength, and nevertheless is simple and compact, and can be produced cost-effectively.

According to the embodiments of the invention, the object is achieved in that the insulation coating is applied without any gaps to the inside of the encapsulation, at least in the region between the isolating contacts, and in that at least one projection is provided on the insulation coating. Firstly, this allows the distance between the encapsulation and the isolating contacts to be reduced, since the insulation coating prevents any discharge which is produced in the direction of the encapsulation during opening of the disconnector from reaching the encapsulation and leading to a heavy-current arc. Secondly, the projection on the insulation coating makes it possible to prevent the opened disconnector from being bridged by creepage currents along the solid insulation coating on the encapsulation.

More compact and cheaper disconnectors can thus be used for the same maximum electrical loads.

BRIEF DESCRIPTION OF THE DRAWINGS

Preferred exemplary embodiments of the invention and the further advantages which can be achieved with them will be explained in the following text with reference to drawings, in which.

The same reference symbols relate to equivalent parts in all the figures.

DETAILED DESCRIPTION OF THE INVENTION

Figure 1:
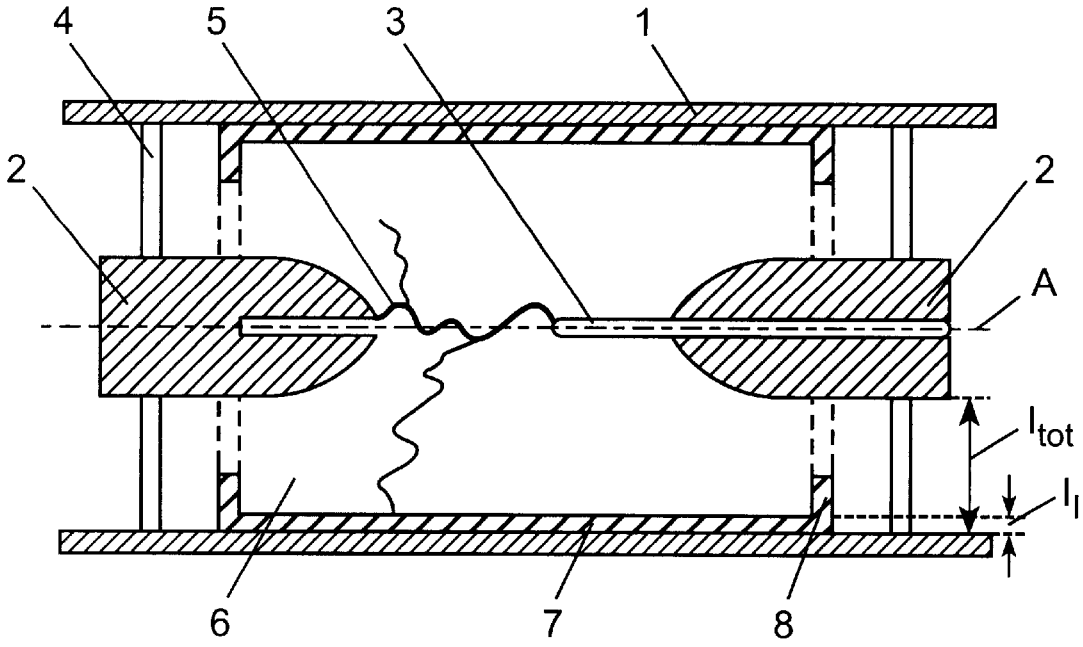
FIG. 1 shows a schematic illustration of a first embodiment of the disconnector according to the invention, during the opening of the disconnector.

FIG. 1 shows a first embodiment of the disconnector according to the invention. Two isolating contacts 2 are located in metallic encapsulation 1 which is filled with insulating gas 6 at atmospheric pressure or at an increased pressure. The isolating contacts are in the form of rounded shielding electrodes. An isolating contact finger 3, which is designed to be moveable, is arranged between the two isolating contacts. The isolating contacts 2 are held centrally in the encapsulation 1 by supporting insulators 4. An insulation coating 7 is arranged on the inside of the encapsulation 1, in the region of the isolation gap between the two isolating contacts 2. The insulation coating 7 in this case advantageously extends into the region of the isolating contacts 2, but not quite as far as the supporting insulator 4, so that there is still an exposed encapsulation section between the supporting insulator 4 and the insulation coating 7. In the region of the isolating contacts 2, the insulation coating 7 has a projection 8, which is formed toward the inside and is composed of dielectric material. This projection 8 makes it possible to prevent any flashovers of the disconnector spark 5 to the insulation coating from propagating in the direction of the encapsulation. The thickness $I_I$ of the insulation coating 7 amounts to less than half the length of the total isolation gap $I_{tot}$ between the isolating contact 2 and the encapsulation 1.

When the disconnector is closed, the isolating contact finger 3 shorts the two isolating contacts 2. When the disconnector is being opened, the isolating contact finger 3 is moved in the direction of the right-hand isolating contact, with disconnector sparks 5 being formed between the end of the left-hand isolating contact and the tip of the isolating contact finger 3. When the disconnector is open, the isolating contact finger 3 is located in the interior of the right-hand isolating contact. In order to close the disconnector, the isolating contact finger is moved in the direction of the left-hand isolating contact, with disconnector sparks once again being formed between the end of the left-hand isolating contact and the tip of the isolating contact finger.

Figure 2:
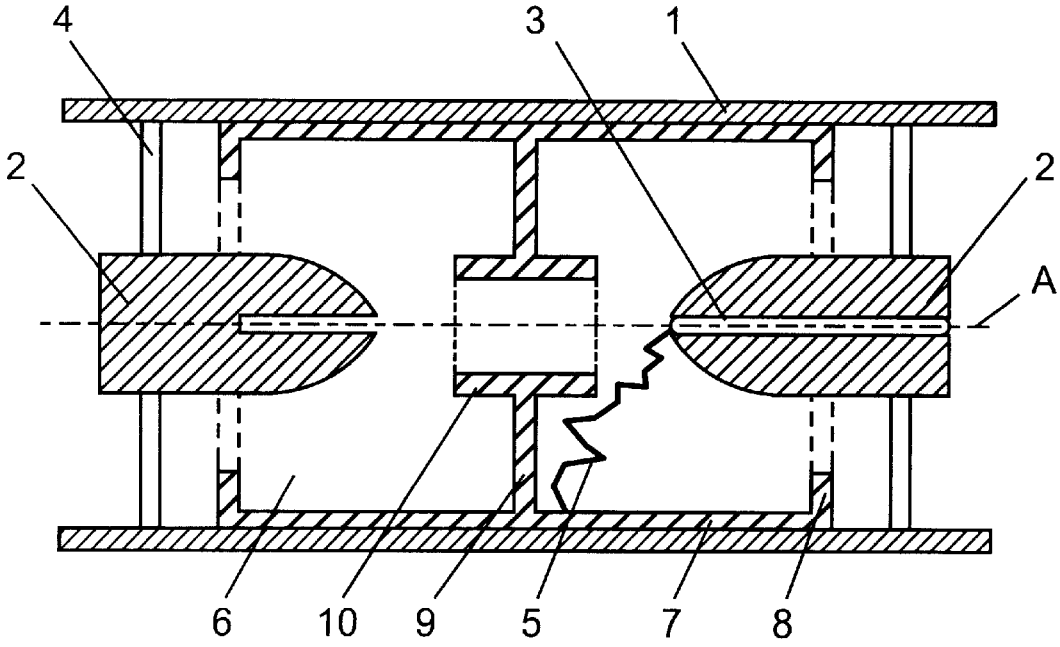
FIG. 2 shows a schematic illustration of a second embodiment of the disconnector according to the invention, when the disconnector is open.

FIG. 2 shows a second embodiment of the disconnector according to the invention. In the region of the center between the two isolating contacts 2, the insulation coating 7 has a projection 9 which is formed inward. At the inner end, the projection has two insulation shields 10, which run on both sides in the direction of the axis A. The insulation shields 10 are tubular and have an opening through which the isolating contact finger 3 can be passed. The insulation coating 7, the projection 9 and the insulation shield 10 together form a type of cup around in each case one of the two isolating contacts 2. Any spark 5 which occurs in the direction of the encapsulation 1 can propagate only within the cup and cannot leave it, since the spark cannot move in the opposite direction to the lines of force or in the opposite direction to its original running direction. This makes it possible to prevent any possible flashover along the solid coating between the two isolating contacts 2.

In order to allow compensation for thermal expansion, the insulation coating 7 is advantageous not firmly connected to the encapsulation 1.

List of Symbols

1 Encapsulation

2 Isolating contact

3 Isolating contact finger

4 Supporting insulator

5 Disconnector spark, arc

6 Insulating gas

7 Insulation coating

8, 9 Projection, barrier

10 Insulation shield $I_I$ Thickness of the insulation coating $I_{tot}$ Length of the isolation gap

What is claimed is:

1. A disconnector, containing at least two isolating contacts, at least one isolating contact finger which is movable along an axis between the isolating contacts and which, when the disconnector is open, is arranged in an interior of one of the isolating contacts, a pressurized, electrically conductive encapsulation, and, an insulation coating which is applied to part of an inside of the encapsulation, wherein the insulation coating is applied without any gaps to the inside of the encapsulation, at least in a region between the isolating contacts, and wherein at least one projection is provided on the insulation coating.

2. The disconnector as claimed in claim 1, wherein a thickness of the insulation coating is at most equal to half a length of an entire isolation gap between the isolating contacts and the encapsulation.

3. The disconnector as claimed in claim 2, wherein the at least one projection is arranged in a region of one edge of the insulation coating.

4. The disconnector as claimed in claim 1, wherein the at least one projection is arranged in the region between the isolating contacts, and wherein the at least one projection is substantially in a form of a disk with a centrally arranged through-opening.

5. The disconnector as claimed in claim 4, wherein a tubular insulation shield, running substantially parallel to the axis, is arranged on the at least one projection in the through-opening.

* * * * *